US007605322B2

(12) United States Patent
Nakamura

(10) Patent No.: US 7,605,322 B2
(45) Date of Patent: Oct. 20, 2009

(54) APPARATUS FOR AUTOMATICALLY STARTING ADD-ON PROGRESSION TO RUN WITH INPUTTED MUSIC, AND COMPUTER PROGRAM THEREFOR

(75) Inventor: Yoshinari Nakamura, Hamamatsu (JP)

(73) Assignee: Yamaha Corporation (JP)

( * ) Notice: Subject to any disclaimer, the term of this patent is extended or adjusted under 35 U.S.C. 154(b) by 28 days.

(21) Appl. No.: 11/535,244

(22) Filed: Sep. 26, 2006

(65) Prior Publication Data

US 2007/0119292 A1 May 31, 2007

(30) Foreign Application Priority Data

Sep. 26, 2005 (JP) ..... 2005-277219
Sep. 26, 2005 (JP) ..... 2005-277220
Sep. 26, 2005 (JP) ..... 2005-277221

(51) Int. Cl.
*G10H 1/38* (2006.01)

(52) U.S. Cl. ..... 84/613; 84/637

(58) Field of Classification Search ..... 84/610–614, 84/634–638

See application file for complete search history.

(56) References Cited

U.S. PATENT DOCUMENTS 5,512,706 A * 4/1996 Kondo ..... 84/634
5,777,253 A * 7/1998 Kurebayashi ..... 84/613
6,211,453 B1 * 4/2001 Kurakake ..... 84/609
7,009,101 B1 * 3/2006 Setoguchi et al. ..... 84/615
7,358,433 B2 * 4/2008 Kondo et al. ..... 84/610
2001/0003944 A1 * 6/2001 Okubo et al. ..... 84/637
2002/0023529 A1 * 2/2002 Kurakake et al. ..... 84/610
2002/0121182 A1 * 9/2002 Kondo et al. ..... 84/637
2003/0126973 A1 * 7/2003 Kung ..... 84/610
2004/0007120 A1 * 1/2004 Futamase et al. ..... 84/622
2005/0145098 A1 * 7/2005 Kondo et al. ..... 84/637

FOREIGN PATENT DOCUMENTS

JP 08-211865 A 8/1996
JP 2002-258838 A 11/2002
JP 2003-099035 A 4/2003
JP 2005-208154 A 8/2005

* cited by examiner

*Primary Examiner*—David S. Warren
(74) *Attorney, Agent, or Firm*—Rossi, Kimms & McDowell LLP

(57) ABSTRACT

As a player inputs a performance of a music piece by playing a musical instrument or singing a song, an add-on apparatus automatically starts an add-on progression such as an accompaniment to the music piece, a score and word display of the music piece and a picture display for the music piece. The apparatus stores a plurality of accompaniment or score-and-word or picture data files each corresponding to each of a plurality of music pieces. The apparatus recognizes the music piece under the performance inputted by the player, selects the accompaniment or score-and-word or picture date file which corresponds to the recognized music piece, and causes the accompaniment progression or score-and-word display or picture display to start automatically and run along with the progression of the music piece automatically.

7 Claims, 9 Drawing Sheets

Functional Block Diagram of First Embodiment

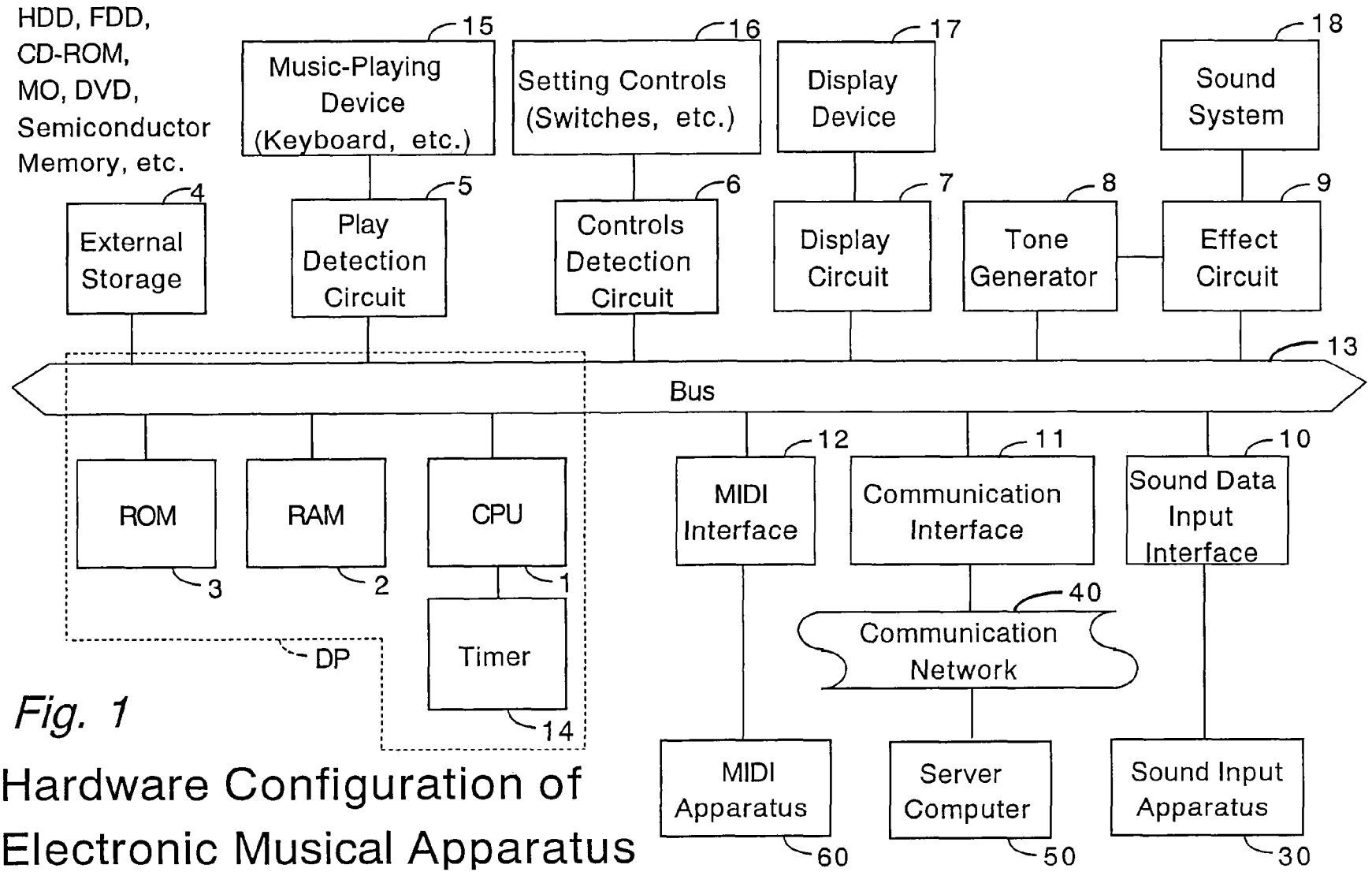
*Fig. 1* Hardware Configuration of Electronic Musical Apparatus

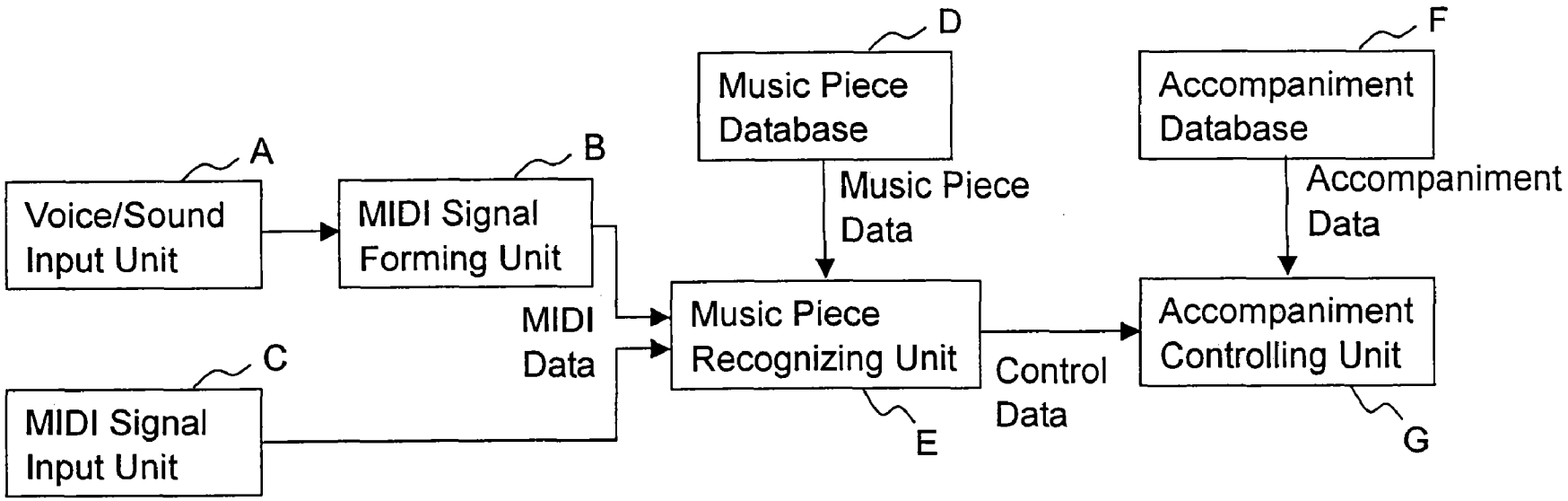
*Fig.2* Functional Block Diagram of First Embodiment

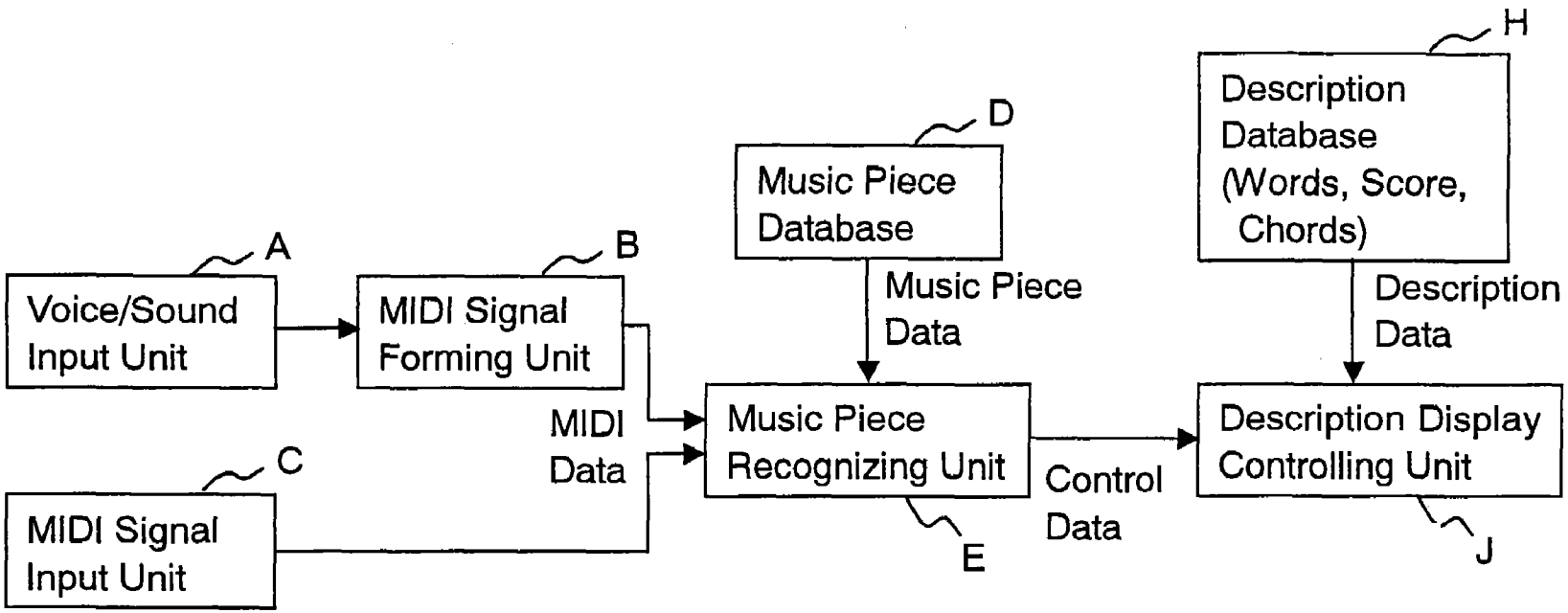
*Fig.3* Functional Block Diagram of Second Embodiment

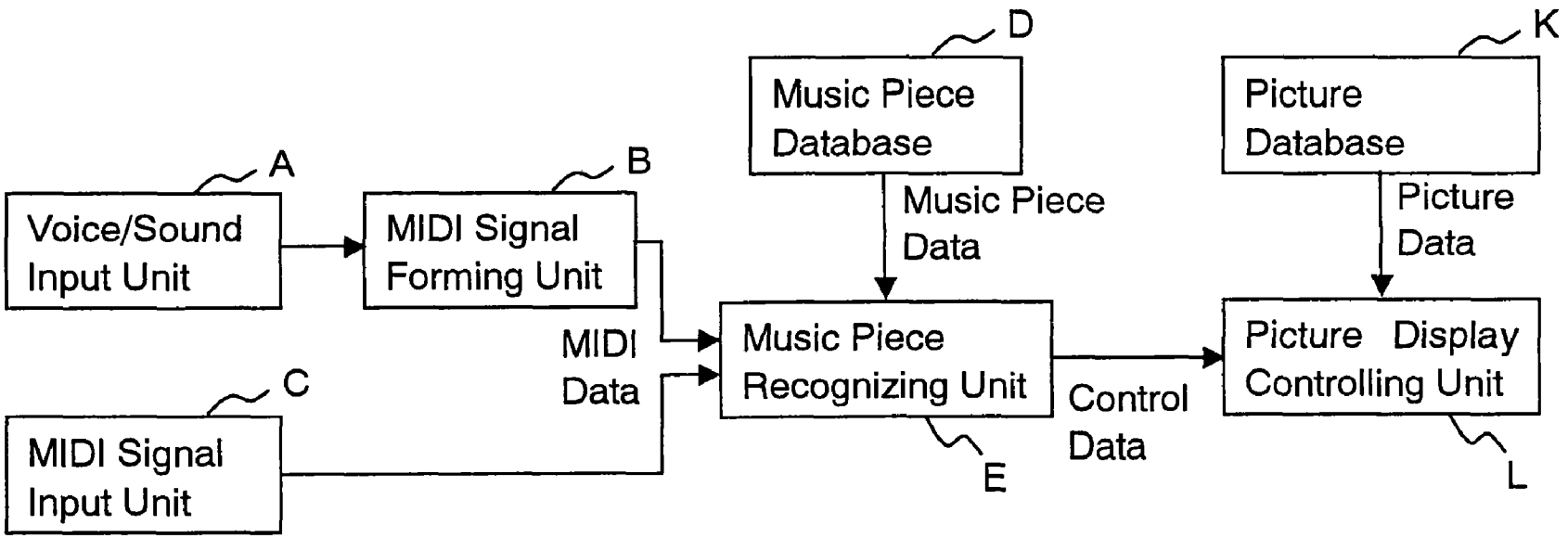
*Fig.4* Functional Block Diagram of Third Embodiment

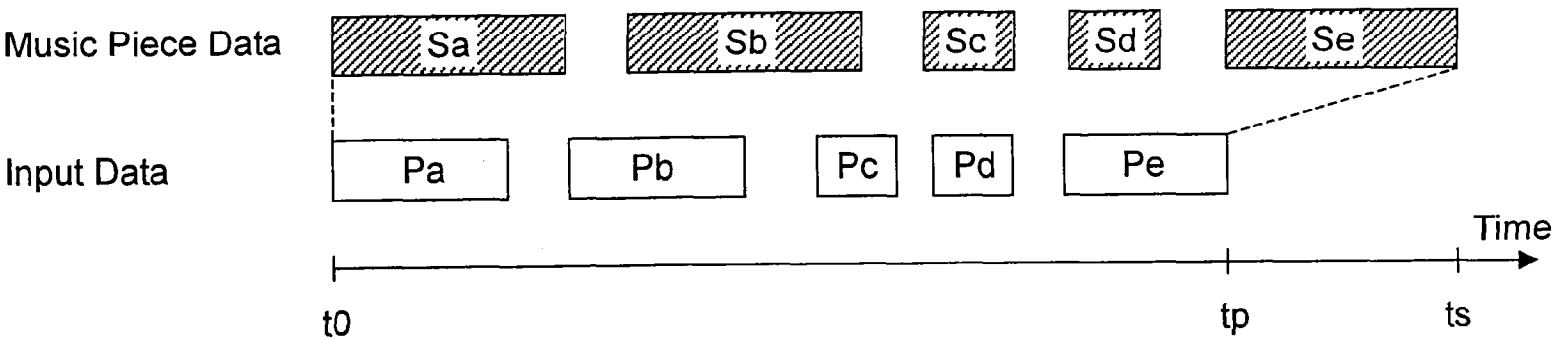
*Fig.5a* Timing Chart of Inputting MIDI Data in Faster Tempo
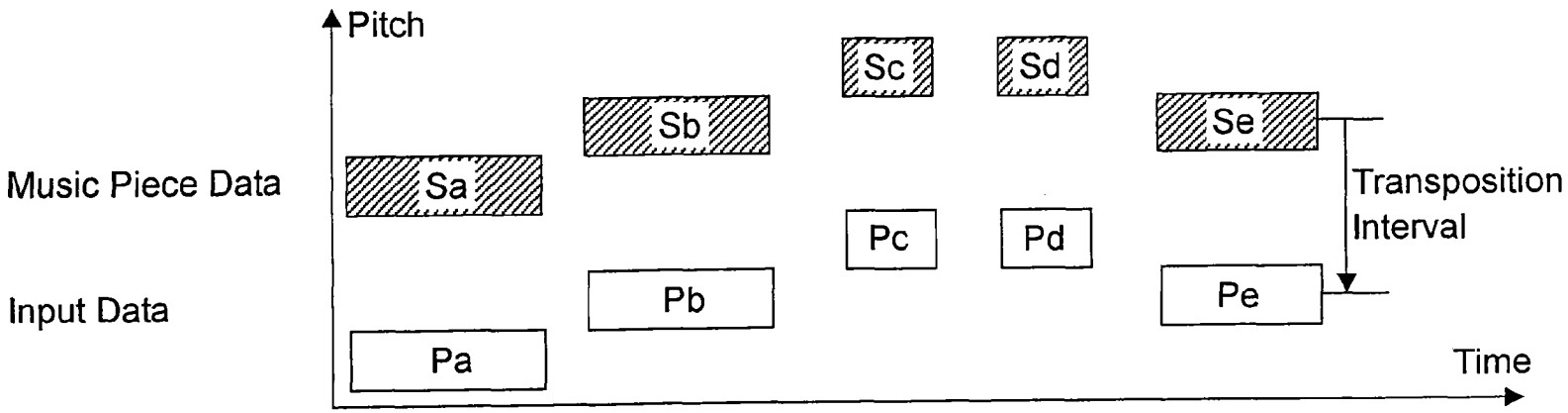
*Fig.5b* Timing Chart of Inputting MIDI Data in Transposed Key

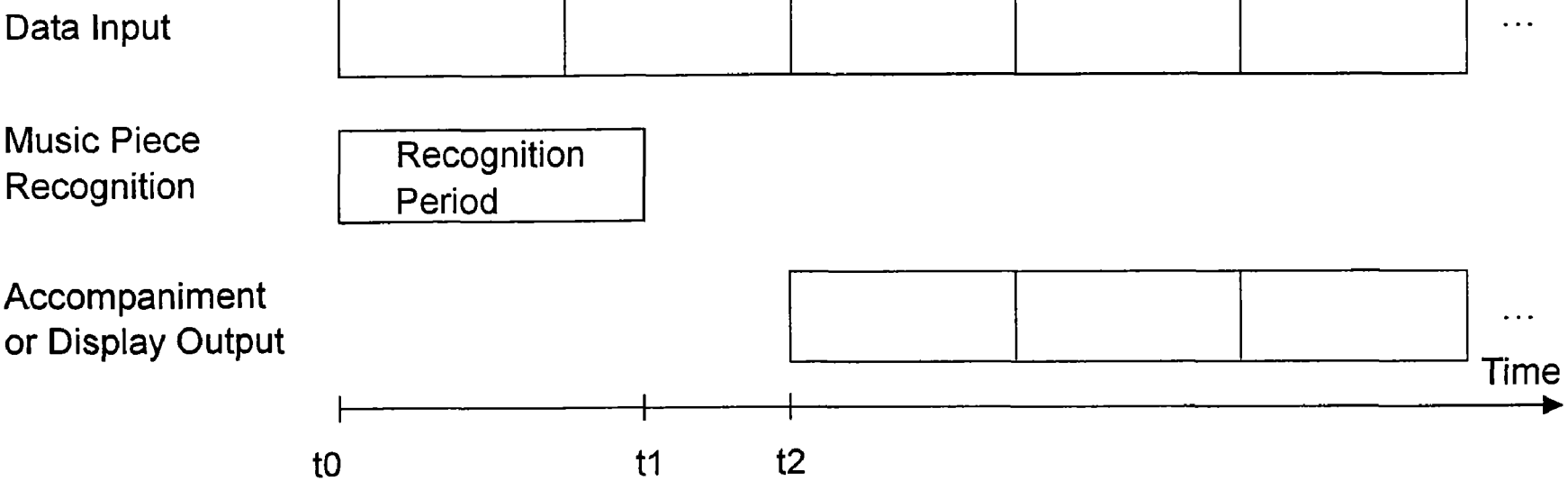
*Fig.6a* Timing Chart of Starting Add-on Progression at Break-in Point

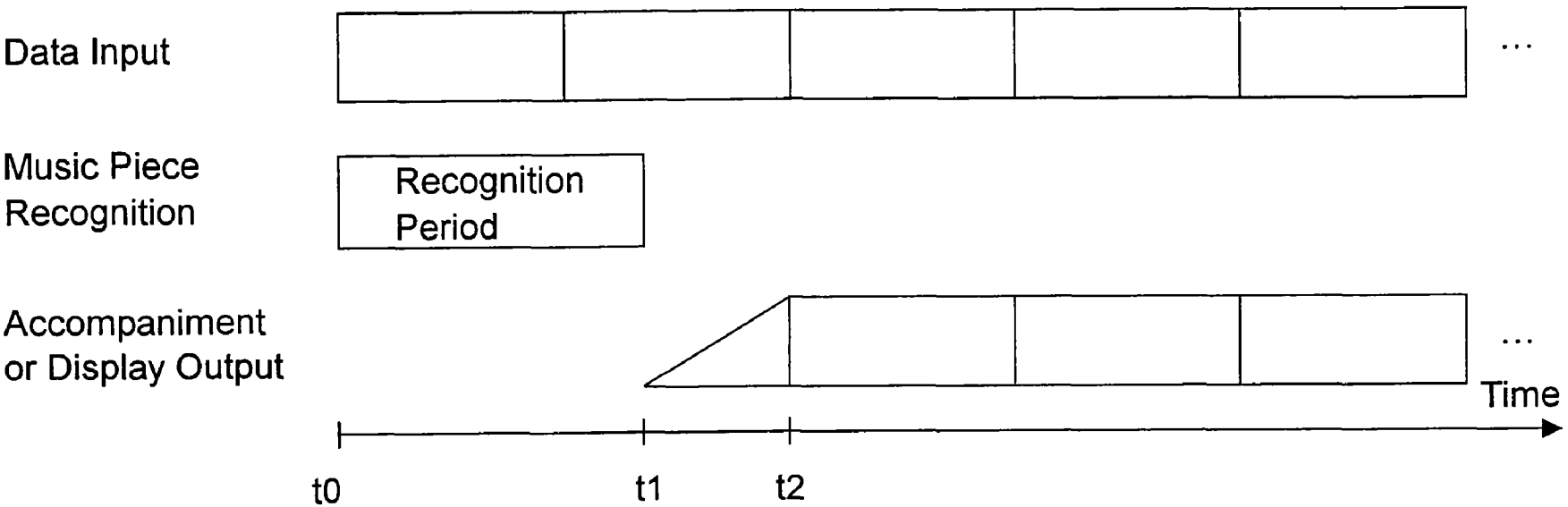
*Fig. 6b* Timing Chart of Fading In Add-on Progression Immediately

*Fig. 7a* Processing for Music Piece Recognition(Part1)
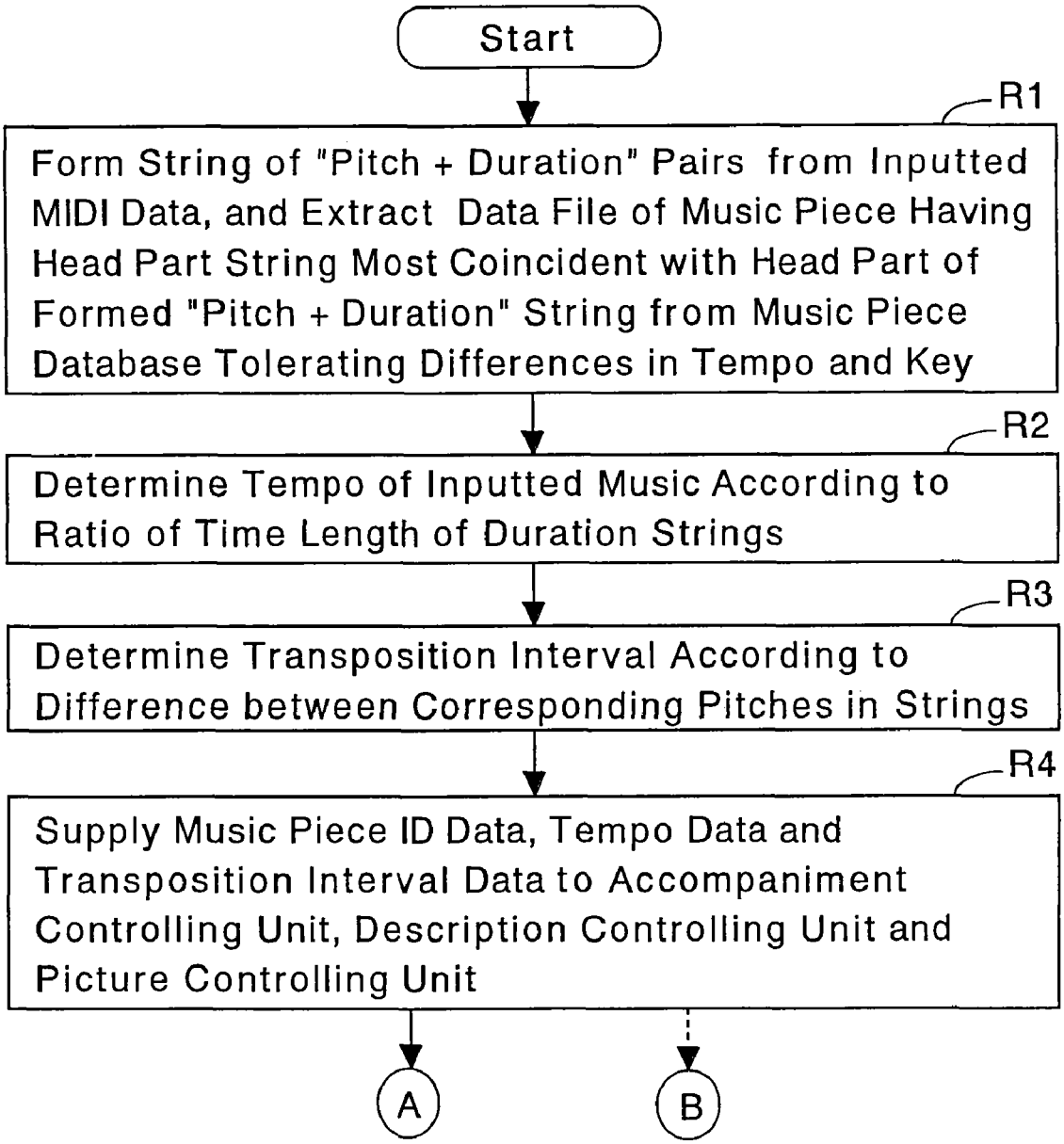

*Fig. 7b* Processing for Music Piece Recognition(Part2)
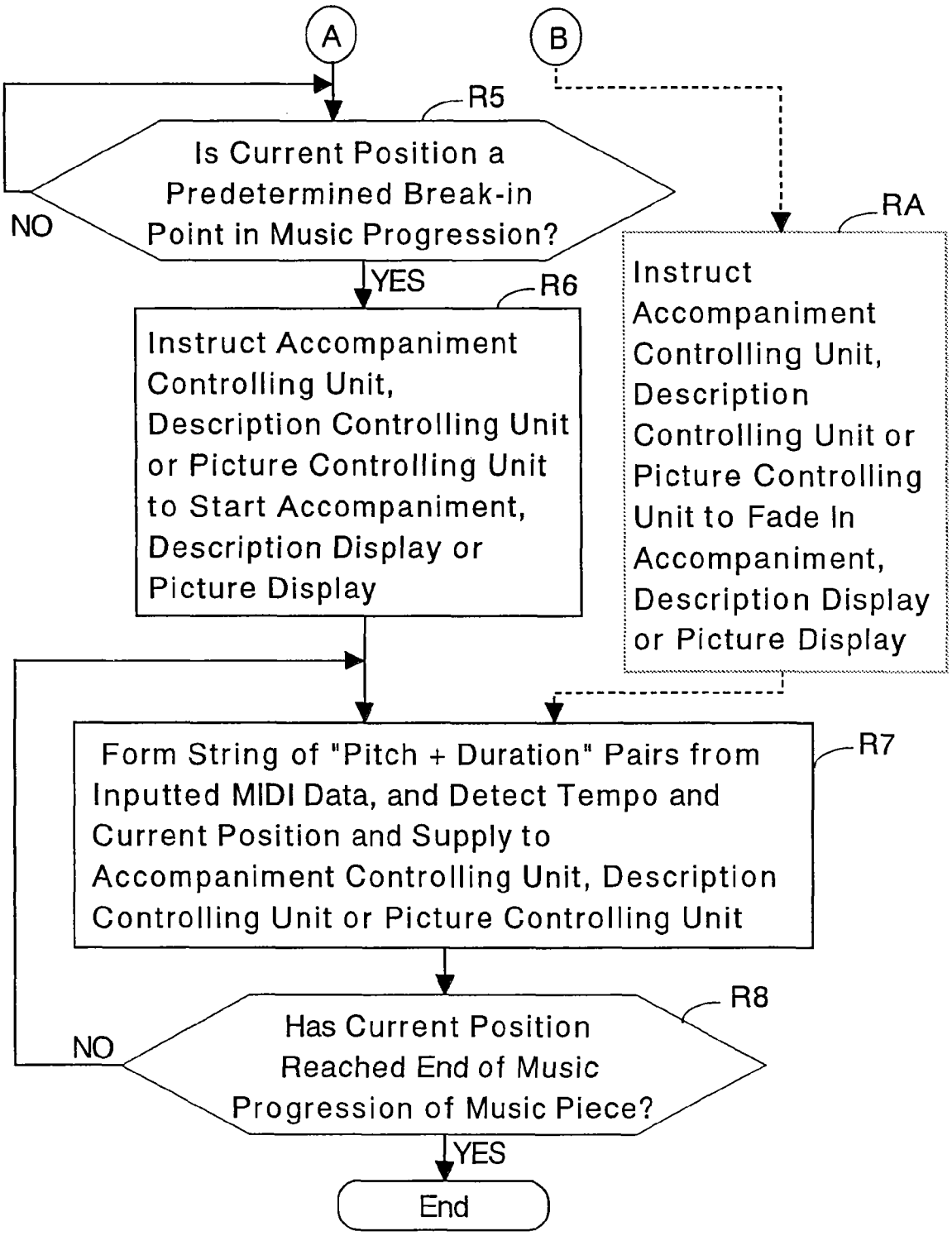

APPARATUS FOR AUTOMATICALLY STARTING ADD-ON PROGRESSION TO RUN WITH INPUTTED MUSIC, AND COMPUTER PROGRAM THEREFOR

TECHNICAL FIELD

The present invention relates to an apparatus for automatically starting an add-on progression to run along with a played music piece, and more particularly to an apparatus for automatically starting an accompaniment to the music piece, a description display of the music piece, and/or a picture display for the music piece, by recognizing the music piece performed by the player as the player starts the performance, selecting an accompaniment and/or description and/or picture data file which matches the recognized music piece, and causing the accompaniment and/or description display and/or picture display to automatically start and run along with the played music piece.

BACKGROUND INFORMATION

An electronic musical apparatus such as an electronic musical instrument which is equipped with an automatic accompaniment device is known in the art as shown in unexamined Japanese patent publication No. H8-211865. With such an automatic accompaniment device, however, the user has to select a desired accompaniment by designating a style data file (accompaniment pattern data file) using the style number and to command the start of the accompaniment, which would be troublesome for the user. Another type of automatic accompaniment device is shown in unexamined Japanese patent publication No. 2005-208154, in which the accompaniment device recognizes a music piece from the inputted performance data, selects a corresponding accompaniment data file to be used for the recognized music piece. However, the user has to command the start of the selected accompaniment.

An electronic musical apparatus such as an electronic musical instrument which is equipped with an automatic description display device such as of a music score and/or words for a song is also known in the art as shown in unexamined Japanese patent publication No. 2002-258838. With such an automatic description display device, however, the user has to select a desired music score and/or words for a song by designating a music piece data file of which the music score and/or the words are to be displayed and to command the start of the display, which would be troublesome for the user.

An electronic musical apparatus such as an automatic musical performance apparatus which is equipped with an automatic picture display device for displaying motion or still pictures as background sceneries or visual supplements for a musical progression is also known in the art as shown in unexamined Japanese patent publication No. 2003-99035. With such an automatic picture display device, however, the user has to select desired pictures for a musical progression by designating a music piece data file for which the pictures are to be displayed and to command the start of the display, which would be troublesome for the user.

SUMMARY OF THE INVENTION

In view of the foregoing background, therefore, it is a primary object of the present invention to provide an apparatus for automatically starting an add-on progression such as an accompaniment to the music piece, a description display of the music piece and a picture display for the music piece to run along with the progression of the music piece performed by the player playing a musical instrument or singing a song.

According to the present invention, the object is accomplished by providing an apparatus for automatically starting an add-on progression to run along with an inputted music progression comprising: an add-on progression storing device which stores a plurality of add-on progression data files each corresponding to each of a plurality of music pieces, each of the add-on progression data files representing a progression of an add-on matter to a progression of each corresponding one of the plurality of music pieces; a performance data input device for inputting performance data representing a musical performance of a music piece played by a player; a music piece recognizing device for recognizing a music piece under the musical performance based on the inputted performance data; an add-on progression selecting device for selecting an add-on progression data file which represents the progression of the add-on matter for the recognized music piece; and an add-on progression causing device for causing the progression of the add-on matter to start automatically and run along with the progression of the music piece automatically according to the selected add-on progression data file upon selection of the add-on progression data file.

According to the present invention, the object is further accomplished by providing an apparatus for automatically starting a musical accompaniment progression to run along with an inputted music progression comprising: an accompaniment storing device which stores a plurality of accompaniment data files each corresponding to each of a plurality of music pieces, each of the accompaniment data files representing a progression of a musical accompaniment to a progression of each corresponding one of the plurality of music pieces; a performance data input device for inputting performance data representing a musical performance of a music piece played by a player; a music piece recognizing device for recognizing a music piece under the musical performance based on the inputted performance data in comparison with reference music data; an accompaniment selecting device for selecting an accompaniment data file which represents the progression of the musical accompaniment for the recognized music piece; and an accompaniment causing device for causing the progression of the musical accompaniment to start automatically and run along with the progression of the music piece automatically according to the selected accompaniment data file upon selection of the accompaniment data file.

In an aspect of the present invention, the music piece recognizing device may recognize also a transposition interval between the inputted performance data and the reference music data, and the accompaniment causing device may cause the progression of the musical accompaniment to start and run in a key adjusted by the recognized transposition interval. The accompaniment causing device may cause the progression of the musical accompaniment to fade in immediately after the music piece under the musical performance is recognized. The progression of the musical accompaniment may have predetermined break-in points along the progression thereof, and the accompaniment causing device may cause the progression of the musical accompaniment to start at a break-in point which comes first among the break-in points after the music piece under the musical performance is recognized.

According to the present invention, the object is further accomplished by providing an apparatus for automatically starting a description display progression to run along with an inputted music progression comprising: a description storing device which stores a plurality of description data files each corresponding to each of a plurality of music pieces, each of the description data files representing a progression of a description display to a progression of each corresponding one of the plurality of music pieces; a performance data input device for inputting performance data representing a musical performance of a music piece played by a player; a music piece recognizing device for recognizing a music piece under the musical performance based on the inputted performance data in comparison with reference music data; a description selecting device for selecting a description data file which represents the progression of the description display for the recognized music piece; and a description display causing device for causing the progression of the description display to start automatically and run along with the progression of the music piece automatically according to the selected description data file upon selection of the description data file.

In another aspect of the present invention, the music piece recognizing device may recognize also a transposition interval between the inputted performance data and the reference music data, and the description display causing device may cause the progression of the description display to start and run in a key adjusted by the recognized transposition interval.

According to the present invention, the object is still further accomplished by providing an apparatus for automatically starting a picture display progression to run along with an inputted music progression comprising: a picture storing device which stores a plurality of picture data files each corresponding to each of a plurality of music pieces, each of the picture data files representing a progression of a picture display to a progression of each corresponding one of the plurality of music pieces; a performance data input device for inputting performance data representing a musical performance of a music piece played by a player; a music piece recognizing device for recognizing a music piece under the musical performance based on the inputted performance data; a picture selecting device for selecting a picture data file which represents the progression of the picture display for the recognized music piece; and a picture display causing device for causing the progression of the picture display to start automatically and run along with the progression of the music piece automatically according to the selected picture data file upon selection of the picture data file.

According to the present invention, the object is still further accomplished by providing a computer readable medium for use in a computer including a storage device which stores a plurality of add-on progression data files each corresponding to each of a plurality of music pieces, each of the add-on progression data files representing a progression of an add-on matter to a progression of each corresponding one of the plurality of music pieces, the medium containing program instructions executable by the computer for causing the computer to execute: a process of inputting performance data representing a musical performance of a music piece played by a player; a process of recognizing a music piece under the musical performance based on the inputted performance data; a process of selecting an add-on progression data file which represents the progression of the add-on matter for the recognized music piece; and a process of causing the progression of the add-on matter to start automatically and run along with the progression of the music piece automatically according to the selected add-on progression data file upon selection of the add-on progression data file, whereby the add-on progression automatically starts and runs along with the inputted music progression.

In a further aspect of the present invention, the add-on progression data files representing a progression of an add-on matter may be accompaniment data files representing a progression of a musical accompaniment so that a selected accompaniment data file will represent the progression of the musical accompaniment for the recognized music piece and that the progression of the musical accompaniment will start and run along with the progression of the music piece.

In a still further aspect of the present invention, the add-on progression data files representing a progression of an add-on matter may be description data files representing a progression of a description display so that a selected description data file will represent the progression of the description display for the recognized music piece and that the progression of the description display will start and run along with the progression of the music piece.

In a still further aspect of the present invention, the add-on progression data files representing a progression of an add-on matter may be picture data files representing a progression of a picture display so that a selected picture data file will represent the progression of the picture display for the recognized music piece and that the progression of the picture display will start and run along with the progression of the music piece.

With the apparatus and the computer program according to the present invention, as a player inputs a performance of a music piece by playing a musical instrument or singing a song, the apparatus automatically starts an add-on progression such as an accompaniment to the music piece, a description display (e.g. score and word display) of the music piece and a picture display for the music piece and runs the add-on progression along with the progression of the music piece.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which:

FIG. 1 is a block diagram illustrating the overall hardware configuration of an electronic musical apparatus incorporating an embodiment of an apparatus for automatically starting an add-on progression according to the present invention;

FIG. 2 is a block diagram illustrating the functional configuration of an apparatus for automatically starting an accompaniment progression as a first embodiment according to the present invention;

FIG. 3 is a block diagram illustrating the functional configuration of an apparatus for automatically starting a description display progression as a second embodiment according to the present invention;

FIG. 4 is a block diagram illustrating the functional configuration of an apparatus for automatically starting a picture display progression as a third embodiment according to the present invention;

FIG. 5*a* is a timing chart illustrating the operation of an embodiment according to the present invention, where the MIDI data are inputted in a faster tempo;

FIG. 5*b* is a timing chart illustrating the operation of an embodiment according to the present invention, where the MIDI data are inputted in a transposed key;

FIG. 6*a* is a timing chart illustrating the operation of an embodiment according to the present invention, where the add-on progression starts at a break-in point;

FIG. 6*b* is a timing chart illustrating the operation of an embodiment according to the present invention, where the add-on progression fades in immediately; and FIGS. 7*a* and 7*b* are, in combination, a flowchart illustrating the processing for music piece recognition in an embodiment according to the present invention.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

General Configuration of Electronic Musical Apparatus

FIG. 1 shows a block diagram illustrating the overall hardware configuration of an electronic musical apparatus incorporating an embodiment of an apparatus for automatically starting an add-on progression according to the present invention. The electronic musical apparatus may be an electronic musical instrument or may be a musical data processing apparatus such as a personal computer (PC) coupled with a music playing unit and a tone generating unit to provide a musical data processing function to be equivalent to an electronic musical instrument. The electronic musical apparatus comprises a central processing unit (CPU) 1, a random access memory (RAM) 2, a read-only memory (ROM) 3, an external storage device (4), a play detection circuit 5, a controls detection circuit 6, a display circuit 7, a tone generator circuit 8, an effect circuit 9, a sound data input interface 10, a communication interface 11 and a MIDI interface 12, all of which are connected with each other via a system bus 13.

The CPU 1, the RAM 2 and the ROM 3 together constitutes a data processing circuit DP, which conducts various music data processing including music piece recognizing processing according to a given control program utilizing a clock signal from a timer 14. The RAM 2 is used as work areas for temporarily storing various data necessary for the processing. The ROM 3 stores beforehand various control programs, control data, music performance data and so forth necessary for executing the processing according to the present invention.

The external storage device 4 may include a built-in storage medium such as a hard disk (HD) as well as various portable external storage media such as a compact disk read-only memory (CD-ROM), a flexible disk (FD), a magneto-optical (MO) disk, a digital versatile disk (DVD), a semiconductor (SC) memory such as a small-sized memory card like Smart Media™ and so forth. Thus various kinds of data including control programs can be stored in various suitable external storage devices 4. Further, any predetermined external storage device (e.g. a HD) 4 can be used for providing a music piece database, an accompaniment database, a description data base, a picture database.

The play detection circuit 5 detects the user's operations of a music-playing device 14 such as a keyboard, and sends the musical performance data in the MIDI format (herein after "MIDI data") representing the user's operations to the data processing circuit DP. The control detection circuit 6 detects the user's operations of the setting controls 16 such as key switches and a mouse device, and sends the settings data representing the set conditions of the setting controls 16 to the data processing circuit DP. The setting controls 16 include, for example, switches for setting conditions of tone signal generation by the tone generator circuit 8 and the effect circuit 9, mode switches for setting modes such as a music piece recognition mode, add-on selection switches for selectively designating the add-on matters such as an accompaniment, a description display and a picture display under the music piece recognition mode, a fade-in switch for commanding "to fade in immediately" with respect to the start of the output such as an accompaniment, and a display selection switch for selectively designating items to be displayed such as a music score, words for the music, chord names, and so forth when the designated output is a description display. The display circuit 7 is connected to a display device 17 such as an LCD panel displaying screen images and pictures and various indicators (not shown) to control the displayed contents and lighting conditions of these devices according to the instructions from the CPU 1, and also presents GUIs for assisting the user in operating the music-playing device 15 and the setting controls 16.

The tone generator circuit 8 and the effect circuit 9 function as a tone signal generating unit (also referred to as a "tone generator unit"), wherein the tone generator circuit 8 generates tone data according to the real-time performance MIDI data derived from the play detection circuit 5 and the effect circuit 9 including an effect imparting DSP (digital signal processor) imparts intended tone effects to the tone data, thereby producing tone signals for the real-time performance. The tone signal generating unit 8+9 also serves to generate tone signals for an accompaniment in accordance with the accompaniment data determined in response to the real-time performance MIDI data during the music piece recognizing processing, and to generate tone signals for an automatic musical performance in accordance with the performance data read out from the storage devices 3 and 4 during the automatic performance processing. To the effect circuit 9 is connected a sound system 18, which includes a D/A converter, an amplifier and a loudspeaker, and emits audible sounds based on the effect imparted musical tone signals from the effect circuit 9.

To the sound data input interface 10 is connected a sound input apparatus 30 which includes a microphone, a sound signal generating device such as an electric guitar, and a sound signal processing circuit. The sound input apparatus 30 digitizes the input signals from the microphone or the sound signal generating device by means of the sound signal processing circuit, thereby converting to sound data, which in turn is sent to the data processing circuit DP via the sound data input interface 10. The sound data sent to the data processing circuit DP may be converted back to sound wave signals through the effect circuit 9 in order to emit audible sounds from the sound system 18 so that input sound signals from the microphone or the sound signal generating device are amplified to sound loud.

The communication interface 11 is to connect the electronic musical apparatus to a communication network 40 such as the Internet and a local area network (LAN) so that control programs and performance data files can be downloaded from an external server computer 50 or the like and stored in the storage device 4 for use in this electronic musical apparatus.

To the MIDI interface 10 is connected an external MIDI apparatus 60 having a MIDI musical data processing function like this electronic musical apparatus so that MIDI musical data can be exchanged between this electronic musical apparatus and the separate or remote MIDI apparatus 60 via the MIDI interface 11. The MIDI data from the external MIDI apparatus 60 representing the manipulations of the music playing device in the external MIDI apparatus can be used in this electronic musical apparatus to generate tone signals of the real-time musical performance by means of the tone signal generating unit 8+9 as in the case of the real-time performance MIDI data generated by the manipulations of the music playing device 15 of this electronic musical apparatus.

Embodiments of Electronic Musical Apparatus

An apparatus for automatically starting an add-on progression to run along with a played music piece according to the present invention conducts a music piece recognition processing when a mode switch manipulated in the setting controls designates the music piece recognition mode, and automatically recognizes or identifies the music piece of which the melody or the song has been started to be played by the user or player, and then automatically starts an add-on progression which matches the music piece to run successively along with the progression of the music piece played by the user. The first embodiment of the present invention is an apparatus for automatically starting an accompaniment to a music piece to run along with the progression of the music piece played by the user, the second embodiment of the present invention is an apparatus for automatically starting a description display such as a display of a music score, words of a song and chord names of the music piece to run along with the progression of the music piece played by the user, and the third embodiment of the present invention is an apparatus for automatically starting a picture display including picture images which match the music piece to run along with the progression of the music piece played by the user. These embodiments will be described in detail herein below with reference to FIGS. 2-4.

First Embodiment

An apparatus for starting an accompaniment to a music piece according to the first embodiment is to function when the add-on selection switch among the setting controls 16 designates the accompaniment function. The apparatus recognizes the music piece which the user has started to play or sing, and selects an adequate accompaniment data file and causes the selected accompaniment to start automatically and run along with the progression of the music piece. FIG. 2 shows a block diagram illustrating the functional configuration of the apparatus for automatically starting an accompaniment progression under the first embodiment. The apparatus is comprised of a voice/sound input unit A, a MIDI signal forming unit B, a MIDI signal input unit C, a music piece database D, a music piece recognizing unit E, an accompaniment database F and an accompaniment controlling unit G. The functional units A-C constitute a performance data input device for inputting the musical performance data in the MIDI format (MIDI data) which can be processed in the music piece recognizing unit E.

The voice/sound input unit A corresponds in function to the sound input apparatus 30 plus the sound data input interface 10. As the user, for example, sings a song or hums a tune or play a melody with a musical instrument such as a guitar, the sounds of the user's performance are inputted through a microphone in the sound input apparatus, the tone signals representing the sound waves of the voices by singing or humming or tones by instrumental playing are digitized by the sound signal processing circuit in the sound input apparatus 30, and the digitized sound data are inputted via the sound data input interface 10 into the data processing circuit DP. The MIDI signal forming circuit B corresponds in function to a MIDI signal forming portion in the data processing circuit DP, and forms a MIDI format signal by analyzing the sound data inputted from the voice/sound input unit A to detect the event times, the pitches, the durations, etc. of the notes, thereby converting the sound data into MIDI data.

The MIDI signal input unit C corresponds in function to the music playing device 15 plus the play detection circuit 5 or to the external MIDI apparatus 60 plus the MIDI interface 12, and inputs the MIDI data generated by the user's operations of the music playing device 15 or the MIDI data received from the external MIDI apparatus 60 into the data processing circuit DP.

The music piece database D corresponds in function to such a portion of the external storage 4 that constitutes the music piece database, and stores music piece data files of a number of music pieces. Each of the music piece data files contains, for example, music piece title data representing the title of the music piece, music piece ID data representing the music piece ID for identifying the music piece, reference tempo data representing the reference tempo value at which the music piece is to be performed, pitch and duration string data (may be simply referred to as "note string data") consisting of an array of pitch and duration pairs (expressed in the pitch-duration coordinate system) representing the pitch and the duration of each of the notes which constitute the music piece and placed along the time axis, and some other necessary data.

The music piece recognizing unit E corresponds in function to a music piece recognizing portion of the data processing circuit DP, and is supplied with the MIDI data converted from the sound data by the MIDI signal forming unit B and the MIDI data inputted via the MIDI signal input unit C. While the illustrated embodiment has two MIDI data input channels, the channel of the voice/sound input unit A plus the MIDI signal forming unit B and the channel of the MIDI signal input unit C, both of the two channels may not necessarily be provided, but either of the two channels may suffice.

The music piece recognizing unit E first converts the supplied MIDI data into string data of the same pitch-and-duration pair format as the pitch-and-duration pair strings of the music piece data files stored in the music piece database D. Then a predetermined length of the head portion (e.g. first several measures) of the supplied MIDI data of pitch-and-duration pair strings are subject to pattern matching processing with the music piece data files in the music piece database D to determine which music piece the supplied MIDI data represents, thereby recognizing or identifying the inputted music piece. More specifically, the music piece data file whose head portion has the closest match in the pitch-and-duration pair array pattern with the head portion of the inputted music data is extracted as the music piece being played by the user.

The music piece recognizing unit E conducts the pattern matching processing of the pitch-and-duration array pattern without taking the tempo and the key of the music progression into consideration, but further compares the pitch arrays and the duration arrays individually between the inputted MIDI data and the extracted music piece data file to determine (detect) the tempo of the inputted MIDI data and the transposition interval. For example, the time length of the pitch-and-duration array of the inputted MIDI data and that of the extracted music piece data file having a matched length of array with each other are compared to obtain the ratio or the difference between the two, and then the tempo of the inputted MIDI data is determined based on the obtained tempo ratio or tempo difference and the reference tempo of the music piece data file. Similarly, the pitch difference (average difference) between the corresponding notes contained in the pitch-and-duration arrays of the inputted MIDI data and of the extracted music piece data file are detected, and then the transposition interval of the inputted MIDI data from the extracted music piece data file is determined based on the detected pitch difference. The music piece recognizing unit E further determines (detects) the time positions of the beats and the bar lines along the progression of the music piece based on the tempo and the time lapsed with respect to the inputted MIDI data.

Finally, the music piece recognizing unit E outputs to the accompaniment controlling unit G a control data signal instructing the start of the accompaniment based on the music piece ID data of the music piece extracted from the music piece database D, and on the tempo, the transposition interval and the time positions along the progression of the MIDI data obtained from the extracted music piece data, and further on the manipulation condition of the fade-in switch among the setting controls 16. Similarly, control data signals will be supplied to the description controlling unit J of the second embodiment shown in FIG. 5 and the picture controlling unit L of the third embodiment shown in FIG. 6.

FIGS. 5*a* and 5*b* show examples of inputting the MIDI data, wherein hollow blocks Pa through Pe denote an array of "pitch-and-duration" data pairs at the head portion of the inputted MIDI data string, and hatched blocks Sa through Se denote an array of "pitch-and-duration" data pairs at the head portion of the music piece data file extracted from the music piece database D correspondent to the inputted MIDI data. As shown in the Figures, the array pattern of the "pitch-and-duration" pairs Pa-Pe in the inputted MIDI data matches with the array pattern of the "pitch-and-duration" pairs Sa-Se in the reference music piece data.

FIG. 5*a* shows a timing chart illustrating the time position pattern of the "pitch-and-duration" data pairs when the MIDI data are inputted in a faster tempo than the reference music piece data. The total time length from t0 to tp of the data array Pa-Pe which is the time length of the duration string constituted by the duration data in the "pitch-and-duration" data pairs at the head portion of the inputted MIDI data is shorter than the total time length from t0 to ts of the data array Sa-Se which is the time length of the duration string constituted by the duration data in the "pitch-and-duration" data pairs at the head portion of the reference music piece data file. Thus, when the tempos of the two musical progression data are different from each other, the tempo of the inputted MIDI data can be obtained by (the tempo value of the reference music piece)×(the time length tp of the inputted duration string)/(the time length ts of the reference duration string).

FIG. 5*b* shows a timing chart illustrating the time and pitch position pattern of the "pitch-and-duration" data pairs when the MIDI data are inputted in a transposed key with respect to the reference music piece data, wherein the pitches of the "pitch-and-duration" data pairs Pa-Pe at the head portion of the MIDI data are indicated by the vertical positions on the chart and the pitches of the "pitch-and-duration" data pairs Sa-Se at the head portion of the reference music piece data are also indicated by the vertical positions on the chart. In the example shown in FIG. 5*b*, the pitches of the notes (i.e. pitch-and-duration pairs) Pa-Pe of the inputted MIDI data are lower than the pitches of the notes Sa-Se of the reference music piece extracted from the music piece database D. Thus, when the pitches of the corresponding notes in the two musical progression data are different from each other, a transposition interval which represents the pitch difference between the inputted pitch string and the reference pitch string (an average pitch difference in the case where the variation patterns of the two pitch strings are not identical) is obtained as illustrated in FIG. 5*b*.

The accompaniment database F corresponds in function to such a portion of the external storage 4 that constitutes the accompaniment database, and stores a number of accompaniment data files with relation to the music piece data files in the music piece database D. The accompaniment data files may be provided in a one-to-one correspondence with the music piece data files, or one accompaniment data file may be commonly used for a plurality of music piece data files. The accompaniment data file provided in a one-to-one correspondence with the music piece data file is an accompaniment data file which is composed for a particular music piece, and can be a length of complete MIDI data file for the accompaniment part of the music piece. The accompaniment data file to be used in common for a plurality of music piece data files will be an accompaniment data file of a generalized style. In the case of a generalized style accompaniment data file, a chord progression data file and a accompaniment section switchover data file (indicating the time points for changing over the accompaniment sections such as an introduction section, a main body section, a fill-in section and an ending section) may be provided separately so that an adequate accompaniment can be given to each music piece.

The accompaniment controlling unit G corresponds in function to such a portion of the data processing circuit DP that performs the function of controlling the accompaniment progression, and automatically selects an accompaniment data file provided for the recognized music piece according to the control data from the music piece recognizing unit E and automatically starts the playback of the accompaniment according to the selected accompaniment data file. More specifically, as the music piece recognizing unit E recognizes the inputted MIDI data to be same as a music piece in the music piece database and gives the music piece ID data of thus identified music piece, the accompaniment controlling unit G selectively reads out the accompaniment data file for the identified music piece from the accompaniment database F, sends to the musical tone generating circuit 8 plus 9 to produce musical tones for the accompaniment, and causes the accompaniment sounds to be emitted from the sound system 14 matching the progression of the MIDI data inputted by the user. Thus, the accompaniment will be started quite naturally at a suitable break-in point designated along the progression of the musical performance according to the accompaniment start instruction contained in the control data from the music piece recognizing unit E with the tempo, the transposition interval and the running position in the progression of the accompaniment being controlled in accordance with the tempo data, the transposition interval data and the progression position data (section switchover positions) in the control data.

FIGS. 6*a* and 6*b* illustrate how the accompaniment or another add-on progression will be started by the accompaniment controlling unit G or another add-on progression controlling unit J or L. FIG. 6*a* illustrates an example of the operation of the case where the accompaniment or another add-on progression will be started at a break-in point according to the accompaniment start instruction after the music piece is recognized by the music piece recognizing unit E when the fade-in switch among the setting controls 16 is not turned on. FIG. 6*b* illustrates an example of the operation of the case where the accompaniment or another add-on progression will be faded in immediately after the music piece is recognized by the music piece recognizing unit E when the fade-in switch is turned on. In each of the Figures, the top row shows a progression of the inputted MIDI data partitioned at the bar line time points, the middle row shows a recognition period which is a time length necessary for the music piece recognizing unit E to recognize (i.e. identify) the music piece of the inputted MIDI data, and the bottom row shows the progression of the accompaniment similarly partitioned by the bar lines.

When the fade-in switch is not turned on, the accompaniment controlling unit G starts, as shown in FIG. 6*a*, the accompaniment at a predetermined break-in time point, and more specifically, at the bar line time point t2 which comes first after the recognition period has past at the time point t1 when the input of the MIDI data is started at the time point t0. On the other hand, when the fade-in switch is turned on, the accompaniment progression is started, as shown in FIG. 6*b*, at the time point t1 immediately after the recognition period has past when the input of the MIDI data is started at the time point t0, in which the volume of the accompaniment starts with a minimum level and gradually increases up to a full level toward the next coming bar line time position t2, namely in a fade-in fashion.

As described above, an apparatus for automatically starting an accompaniment to a music piece of the first embodiment stores music piece data files for a number of music pieces in the music piece database D and accompaniment data files of a generalized style or else for the respective music pieces in the accompaniment database F. As the user starts performing a music piece by playing an instrument or by singing, the performed music is inputted in MIDI data (A-C), a music piece data file which has a note string pattern coincident with the note pattern of the inputted MIDI data is extracted from the music piece database D whereby the music piece the user has started performing is recognized or identified, and further the tempo, the transposition interval, the progression points (e.g. bar lines), etc. of the inputted MIDI data are detected (E). And then, an accompaniment data file which meets the recognized music piece is automatically selected from the accompaniment database F, and an automatic accompaniment takes place in the detected tempo and transposition interval with the progression points synchronized with the MIDI data progression (G). The automatic accompaniment can be started at an adequate break-in point such as the bar line position or can be faded in immediately to realize a musically acceptable start of the accompaniment.

Second Embodiment

An apparatus for starting a description display to a music piece according to the second embodiment is to function when the add-on selection switch among the setting controls 16 designates the description display function. The apparatus recognizes the music piece which the user has started to play or sing, and selects an adequate description data file containing data for displaying descriptions such as a music score, words and chords for the recognized music piece and automatically starts displaying the selected descriptions to run along with the progression of the music piece. FIG. 3 shows a block diagram illustrating the functional configuration of the apparatus for automatically starting a description display progression under the second embodiment. The apparatus is comprised of a voice/sound input unit A, a MIDI signal forming unit B, a MIDI signal input unit C, a music piece database D, a music piece recognizing unit E, a description database H and a description display controlling unit J. The performance data inputting units A-C, the music piece recognizing arrangement D-E are the same as in the first embodiment, but the add-on progression presenting arrangement here comprises description database H containing music scores, words, chords, etc. for a number of music pieces and a description display control unit J for controlling the display of the progression of those descriptions to run along with the progression of the music piece.

The description database H corresponds in function to such a portion of the external storage 4 that constitutes the description database, and stores a number of description data files with relation to the music piece data files in the music piece database. The description data file contains data representing a music score, words, chords, etc. to be displayed along with the progression of the related music piece. The description database H can store the description data in any of the form of a "music score+words+chords" set, or a "music score+words" set, or a "words+chords" set, or a "music score+chords," or a "music score" alone, or "words" alone, or "chords" alone.

The music score data stored in the description database H may be music score image data in a bit-map style, or may be logical music score data representing musical notation symbols, their display locations and their display times, or may be MIDI performance data based on which music score image data can be generated. The words data may be image data for depicting the word constituting characters, or may be text data including character codes, word timing and page turning marks. The chord data may preferably be data in the text format.

The description display controlling unit J corresponds in function to such a portion of the data processing circuit DP that performs the function of controlling the description display progression, and automatically selects a description data file (according to the setting by the display selection switch, at least one of music score data, words data, or chords data can be designated) provided for the recognized music piece according to the control data from the music piece recognizing unit E and automatically starts the display of the musical descriptions according to the selected description data file. More specifically, as the music piece recognizing unit E recognizes the inputted MIDI data to be same as a music piece in the music piece database and gives the music piece ID data of thus identified music piece, the description display controlling unit J selectively reads out the description data file for the identified music piece from the description database H, sends to the display circuit 7 to display on the display device 17 the descriptions for the music piece which corresponds to the MIDI data inputted by the user. When displaying the musical descriptions, the display processing will be controlled in accordance with the tempo, the transposition interval and the progressing position as detected by the music piece recognizing unit E so that adequate descriptions will be successively displayed along with the progression of the inputted MIDI data. For example, the wipe speed for the respective descriptions will be varied according to the tempo, the music score and the chord names will be altered according to the transposition interval, and the displayed pages will be turned according to the progression positions of the music piece.

The fashion in which the display of the descriptions starts may be similar to the fashions in which the accompaniment starts in the above first embodiment. The display of the descriptions may be started at a break-in point after the recognition of the music piece has been completed as shown in FIG. 6*a*, or may be started immediately after the music piece recognition has been completed. When starting the display immediately after the music piece recognition, the display may be faded in immediately as shown in FIG. 6*b* or may be simply started suddenly. The description display of the second embodiment may be added on solely to the music piece progression, or may be added on together with the accompaniment of the first embodiment by so setting the add-on selection switch in the setting controls 16.

As described above, an apparatus for automatically starting a description display to a music piece of the second embodiment stores music piece data files for a number of music pieces in the music piece database D and description data files for displaying musical descriptions such as a music score, words and chords for each music piece to supplement the progression of the music piece in the description database H. As the user starts performing a music piece by playing an instrument or by singing, the performed music is inputted in MIDI data (A-C), a music piece data file which has a note string pattern coincident with the note pattern of the inputted MIDI data is extracted from the music piece database D whereby the music piece the user has started performing is recognized or identified, and further the tempo, the transposition interval, the progression points (e.g. bar lines), etc. of the inputted MIDI data are detected (E). And then, a musical description display data file which meets the recognized music piece is automatically selected from the description database H, and an automatic display of the musical descriptions takes place in the detected tempo and transposition interval with the progression points synchronized with the MIDI data progression (J).

Third Embodiment

An apparatus for starting a picture display to a music piece according to the third embodiment is to function when the add-on selection switch among the setting controls 16 designates the picture display function. The apparatus recognizes the music piece which the user has started to play or sing, and selects an adequate picture data file containing data for displaying pictures (motion or still) for the recognized music piece and automatically starts displaying the selected pictures to run along with the progression of the music piece. FIG. 4 shows a block diagram illustrating the functional configuration of the apparatus for automatically starting a picture display progression under the third embodiment. The apparatus is comprised of a voice/sound input unit A, a MIDI signal forming unit B, a MIDI signal input unit C, a music piece database D, a music piece recognizing unit E, a picture database K and a picture display controlling unit L. The performance data inputting units A-C, the music piece recognizing arrangement D-E are the same as in the first and second embodiments, but the add-on progression presenting arrangement here comprises the picture database K for a number of music pieces and a picture display control unit L for controlling the display of the progression of the pictures to run along with the progression of the music piece.

The picture database K corresponds in function to such a portion of the external storage 4 that constitutes the picture database, and stores a number of picture data files with relation to the music piece data files in the music piece database D. The picture data file may contain data representing motion pictures such as of the images of the artist of each music piece, background images for karaoke music, animation images to meet the progression of each music piece, or may be a set of still pictures to be displayed successively such as of the images of the artist of each music piece, background images or story pictures to meet the progression of each music piece. The picture database K may contain picture data files for the music pieces in one-to-one correspondence, or one picture data file in common for a number of music pieces.

The picture display controlling unit L corresponds in function to such a portion of the data processing circuit DP that performs the function of controlling the picture display progression, and automatically selects a picture data file provided for the recognized music piece according to the control data from the music piece recognizing unit E and automatically starts the display of the pictures according to the selected picture data file. More specifically, as the music piece recognizing unit E recognizes the inputted MIDI data to be same as a music piece in the music piece database and gives the music piece ID data of thus identified music piece, the picture display controlling unit L selectively reads out the picture data file for the identified music piece from the picture database K, sends to the display circuit 7 to display on the display device 17 the pictures for the music piece which corresponds to the MIDI data inputted by the user. When displaying the pictures, the display processing will be controlled in accordance with the tempo and the progressing position as detected by the music piece recognizing unit E so that adequate pictures will be successively displayed along with the progression of the inputted MIDI data. For example, the playback speed of the motion picture will be varied according to the tempo, and the displayed pages of the still pictures will be turned an accordance with the progressing positions of the music piece.

The transposition interval detected by the music piece recognizing unit E is not used in controlling the picture display. Further, the fashion in which the display of the pictures starts may be similar to the fashions in which the accompaniment starts in the above first embodiment. Namely, the display of the pictures may be started at a break-in point after the recognition of the music piece has been completed as shown in FIG. 6*a*, or may be started immediately after the music piece recognition has been completed. When starting the display immediately after the music piece recognition, the display may be faded in immediately as shown in FIG. 6*b* or may be simply started suddenly.

The picture display of the third embodiment may be added on solely to the music piece progression, or may be added on together with the accompaniment of the first embodiment and/or the description display of the second embodiment by so setting the add-on selection switch in the setting controls 16. Further, where the story pictures are to be displayed, the story telling voice data may preferably be stored so that the story telling voices will be played back along with the progression of the display of the story pictures.

As described above, an apparatus for automatically starting a picture display to a music piece of the third embodiment stores music piece data files for a number of music pieces in the music piece database D and picture data files each of a motion picture or a set of still pictures for displaying pictures for each music piece to supplement the progression of the music piece in the picture database K. As the user starts performing a music piece by playing an instrument or by singing, the performed music is inputted in MIDI data (A-C), a music piece data file which has a note string pattern coincident with the note pattern of the inputted MIDI data is extracted from the music piece database D whereby the music piece the user has started performing is recognized or identified, and further the tempo, the progression points (e.g. bar lines), etc. of the inputted MIDI data are detected (E). And then, a picture display data file which meets the recognized music piece is automatically selected from the picture database K, and an automatic display of the pictures takes place in the detected tempo with the progression points synchronized with the MIDI data progression (L).

Processing Flow

FIGS. 7*a* and 7*b* show, in combination, a flowchart illustrating the processing for music piece recognition in an embodiment according to the present invention. This processing flow starts when the user manipulates the mode switch among the setting controls 16 to set the music piece recognition mode on the electronic musical apparatus and the add-on selection switch to designate the add-on matters, the accompaniment and/or the description display and/or picture display, and is executed by the music piece recognizing unit E.

As the processing for music piece recognition starts, the first step R1 converts the inputted MIDI data from the performance data input units A-C to form a string data of "pitch and duration" pairs, subjects a length of the head part of thus formed "pitch and duration" pair string to a pattern matching processing (i.e. comparison) with the head portions of the music piece data files in the music piece database D tolerating the differences in the tempo and the key, and extracts the music piece data file which has the head part string pattern most coincident with the head part string pattern of the formed "pitch and duration" pairs from the music piece database D, thus recognizing or identifying the music piece by its music piece ID data.

Next, a step R2 determines the tempo of the inputted MIDI data according to the ratio tp/ts of the time lengths of at the corresponding head parts of the inputted MIDI data and of the extracted music piece data file as shown in FIG. 5*a*. Subsequent to the step R2, a step R3 determines the transposition interval of the inputted MIDI data from the extracted reference music piece data file according to the difference between the corresponding pitches in the two strings as shown in FIG. 5*b*.

Then, a step R4 supplies the music piece ID data of the extracted music piece data file and the data representing the tempo determined by the step R2 and the transposition interval determined by the step R3 to the accompaniment controlling unit G and/or the description display controlling unit J and/or the picture display controlling unit L (as designated by the add-on selection switch) as the control data therefor. For example, in the case where the add-on selection switch designates an accompaniment operation, these control data are supplied to the accompaniment controlling unit G, and where the add-on selection switch designates a description display operation, these control data are supplied to the description display controlling unit J, and where the add-on selection switch designates a picture display operation, these control data are supplied to the picture display controlling unit L.

A step R5 (in FIG. 7*b*) determines the current position of the inputted MIDI data in the progression of the music piece recognized in the step R1 and judges whether the current position is a predetermined break-in point in the music piece progression. As long as the current position of the inputted MIDI data does not reach the break-in point, the judgment by the step R5 is negative (NO), and goes back to the step R5 to keep on checking. Once the current position of the user's performance reaches the break-in point in the music piece progression, the judgment by the step R5 becomes affirmative (YES), and the process flow moves forward to a step R6, which instructs the designated one or ones of the accompaniment controlling unit G, the description display controlling unit J and the picture display controlling unit L to start the accompaniment and/or the description display and/or the picture display. For example, where the add-on selection switch designates an accompaniment operation, the start instruction is supplied to the accompaniment controlling unit G to start the accompaniment, and where the add-on selection switch designates a description display operation, the start instruction is supplied to the description display controlling unit J to start the description display (of the music score, the words and/or the chords), and where the add-on selection switch designates a picture display operation, the start instruction is supplied to the picture display controlling unit L to start the picture display.

On the other hand, when the fade-in switch is turned on in the setting controls 16, the process flow proceeds, after the step R4 supplying the music piece ID data, the tempo data, the transposition interval data to the control unit G, J and/or L, to a step RA as shown in dotted line (in FIG. 7*b*) to instruct the control unit G, J and/or L to start in a fade-in fashion immediately as shown in FIG. 6*b*.

After the step R6 or the step RA instructs to start the accompaniment and/or the description display and/or the picture display, a step R7 forms the string data of "pitch and duration" pairs from the inputted MIDI data supplied from the performance data input units A-C successively, and detects the tempo and the progressing point (current position), and supplies the data representing the detected tempo and progressing point to the designated one/ones of the accompaniment controlling unit G. the description display controlling unit J and the picture display controlling unit L. Next, a step R8 judges whether the current position of the inputted MIDI data has reached the end of the music piece, and if the judgment is negative (NO), it means the current position has not reached the end of the music piece represented by the inputted MIDI data and the process flow goes back to the step R8 to repeat the judgment until the current position reaches the end of the music piece, i.e. until the judgment becomes affirmative (YES), successively continuing the supply of the control data to the designated controlling unit G, J and/or L.

Thus, the accompaniment controlling unit G, the description controlling unit J and/or the picture display controlling unit L starts in the starting fashion defined by the start instruction based on the control data supplied thereto, whereby an accompaniment, a description display (of a music score, words, chords, etc.) and/or a picture display which matches the inputted MIDI data in tempo and in progressing position is automatically started. As the progressing position of the inputted MIDI data reaches the end of the music piece, the judgment at the step R8 becomes affirmative (YES) and the whole processing of the music recognition comes to an end.

Various Embodiments

While several preferred embodiments have been described and illustrated in detail herein above with reference to the drawings, the present invention can be practiced with various modifications without departing from the spirit of the present invention. For example, in the described embodiments, the inputted MIDI data are converted to the string data of "pitch and duration" pairs and such "pitch and duration" pairs are subject to the pattern matching processing with the "pitch and duration" pairs of the music piece data file stored in the music piece database D to recognize or identify the music piece, the comparison method is not necessarily be limited to such a method, but may be practiced by storing the music piece data files in the music piece database in the MIDI data format and comparing the inputted MIDI data per se directly with the stored music piece data files in the MIDI format.

Alternatively, the music piece data file in the music piece database D may be stored in another data format (e.g. a waveform characteristics data representing the characteristics of the tone waveform) than the MIDI data format and the note array pattern format and the inputted voice/sound data or the MIDI data may be converted to such another data format (e.g. waveform characteristics data) for the music piece recognition processing. The point is that the inputted MIDI data or voice/sound data has to be converted to the same data format as the data format of the music piece data files in the music piece database D to compare with each other. Any kinds of data format can be employed.

Further, in place of digitizing the input signals by the sound input apparatus 30 to send the digitized sound data to the sound data input interface 10, the sound input apparatus 30 may not include a sound signal processing circuit for digitization and the sound signal per se may be sent to the sound data input interface 10, and a further sound signal processing circuit for digitization may be provided in the electronic musical apparatus system to digitize the tone signals into tone data.

Although the music piece database, the accompaniment database, the musical description database and the picture database are provide as separate databases, each of the music piece data files may correspondingly include the accompaniment data, the musical description data and the picture data therein to constitute a single database.

While particular embodiments of the invention and particular modifications have been described, it should be expressly understood by those skilled in the art that the illustrated embodiments are just for preferable examples and that various modifications and substitutions may be made without departing from the spirit of the present invention so that the invention is not limited thereto, since further modifications may be made by those skilled in the art, particularly in light of the foregoing teachings.

It is therefore contemplated by the appended claims to cover any such modifications that incorporate those features of these improvements in the true spirit and scope of the invention.

What is claimed is:

1. An apparatus for automatically starting an add-on progression to run along with an input music progression, comprising:

an add-on progression storing device that stores a plurality of add-on progression data files each corresponding to one of a plurality of music pieces, each of said add-on progression data files representing a progression of an add-on matter, which includes at least one of an accompaniment, a description display, or a picture display corresponding to the respective music piece, corresponding to a progression of one of said plurality of music pieces;

a performance data input device for inputting performance data including pitch-and-duration string data representing a musical performance of a music piece played by a player;

a music piece recognizing device for recognizing a music piece under said musical performance based on said input performance data in comparison with reference music data including pitch-and-duration string data of reference music pieces, the recognized music piece having predetermined break-in time points;

an add-on progression selecting device for selecting an add-on progression data file that represents the progression of the add-on matter for said recognized music piece; and an add-on progression device for detecting the progression points of said input performance data in reference to the predetermined break-in time points of said recognized music piece, and automatically starting the progression of the add-on matter in synchronism with a predetermined break-in time point that comes first among the predetermined break-in time points after a music piece recognition period in which the music piece recognizing device recognizes the music piece, thereby automatically running said progression of the add-on matter along with the progression of said music piece according to said selected add-on progression data file upon selection of said add-on progression data file.

2. An apparatus for automatically starting a musical accompaniment progression to run along with an input music progression, comprising:

an accompaniment storing device that stores a plurality of accompaniment data files each corresponding to one of a plurality of music pieces, each of said accompaniment data files representing a progression of a musical accompaniment corresponding to a progression of one of said plurality of music pieces;

a performance data input device for inputting performance data including pitch-and-duration string data representing a musical performance of a music piece played by a player;

a music piece recognizing device for recognizing a music piece under said musical performance based on said input performance data in comparison with reference music data including pitch-and-duration string data of reference music pieces, the recognized music piece having predetermined break-in time points;

an accompaniment selecting device for selecting an accompaniment data file that represents the progression of the musical accompaniment for said recognized music piece; and an accompaniment device for detecting the progression points of said input performance data in reference to the predetermined break-in time points of said recognized music piece, and automatically starting the progression of the musical accompaniment in synchronism with a predetermined break-in time point that comes first among the predetermined break-in time points after a music piece recognition period in which the music piece recognizing device recognizes the music piece, thereby automatically running said progression of the musical accompaniment along with the progression of said music piece according to said selected accompaniment data file upon selection of said accompaniment data file.

3. An apparatus as claimed in claim 2, wherein said music piece recognizing device recognizes also a transposition interval between said input performance data and said recognized music piece from said reference music data, and said accompaniment device runs said progression of the musical accompaniment in a key adjusted by said recognized transposition interval.

4. An apparatus as claimed in claim 3, wherein said accompaniment device fades in said progression of the musical accompaniment immediately after said music piece under said musical performance is recognized and completes the fade in at the first predetermined break-in time point.

5. An apparatus as claimed in claim 2, wherein said accompaniment device fades in the progression of the musical accompaniment immediately after said music piece under said musical performance is recognized and completes the fade in at the first predetermined break-in time point.

6. A computer readable medium storing a computer program for an apparatus for automatically starting an add-on progression to run along with an input music progression, the apparatus including a storage device that stores a plurality of add-on progression data files each corresponding to one of a plurality of music pieces, each of said add-on progression data files representing a progression of an add-on matter, which includes at least one of an accompaniment, a description display, or a picture display corresponding to the respective music piece, corresponding to a progression of one of said plurality of music pieces, said computer program containing:

an inputting instruction configured to input performance data including pitch-and-duration string data representing a musical performance of a music piece played by a player;

a recognizing instruction configured to recognize a music piece under said musical performance based on said input performance data in comparison with reference music data including pitch-and-duration string data of reference music pieces, the recognized music piece having predetermined break-in time points;

a selecting instruction configured to select one of the add-on progression data files that represents the progression of the add-on matter for said recognized music piece; and an add-on progression instruction for detecting the progression points of said input performance data in reference to the predetermined break-in time points of said recognized music piece, and automatically starting the progression of the add-on matter in synchronism with a predetermined break-in time point that comes first among the predetermined break-in time points after a music piece recognition period in which the recognizing instruction recognizes the music piece, thereby automatically running the progression of the add-on matter along with the progression of said music piece according to said selected add-on progression data file upon selection of said add-on progression data file.

7. A computer readable medium storing a computer program for an apparatus for automatically starting a musical accompaniment progression to run along with an input music progression, the apparatus including a storage device that stores a plurality of accompaniment data files each corresponding to one of a plurality of music pieces, each of said accompaniment data files representing a progression of a musical accompaniment corresponding to a progression of one of said plurality of music pieces, said computer program containing:

an inputting instruction configured to input performance data including pitch-and-duration string data representing a musical performance of a music piece played by a player;

a recognizing instruction configured to recognize a music piece under said musical performance based on said input performance data in comparison with reference music data including pitch-and-duration string data of reference music pieces, the recognized music piece having predetermined break-in time points;

a selecting instruction configured to select one of the accompaniment data files that represents the progression of the musical accompaniment for said recognized music piece; and an accompaniment instruction for detecting the progression points of said input performance data in reference to the predetermined break-in time points of said recognized music piece, and automatically starting the progression of the musical accompaniment in synchronism with a predetermined break-in time point that comes first among the predetermined break-in time points after a music piece recognition period in which the recognizing instruction recognizes the music piece, thereby automatically running the progression of the musical accompaniment along with the progression of said music piece according to said selected accompaniment data file upon selection of said accompaniment data file.

* * * * *